United States Patent [19]

Bewlay et al.

[11] Patent Number: 5,019,330

[45] Date of Patent: May 28, 1991

[54] METHOD OF FORMING IMPROVED TUNGSTEN INGOTS

[75] Inventors: Bernard P. Bewlay, Schenectady; James Day, Scotia, both of N.Y.

[73] Assignee: General Electric Company, Schenectady, N.Y.

[21] Appl. No.: 562,348

[22] Filed: Aug. 3, 1990

[51] Int. Cl.[5] ..... B22F 1/00

[52] U.S. Cl. ..... 419/39; 419/23; 419/42; 419/58; 75/248

[58] Field of Search ..... 419/39, 42, 23, 58; 75/248

[56] References Cited

U.S. PATENT DOCUMENTS

| | | | |
|---|---|---|---|
| 3,443,143 | 5/1969 | Koo | 313/311 |
| 3,661,536 | 5/1972 | Shimizu et al. | 75/248 |
| 3,838,486 | 10/1974 | Millner et al. | 75/248 |
| 3,853,492 | 12/1974 | Millner et al. | 75/248 |
| 3,927,989 | 12/1975 | Koo | 419/28 |
| 4,931,252 | 6/1990 | Brunisholz | 75/248 |

OTHER PUBLICATIONS

"The Application of Tungsten Wire as the Light Source in Incandescent Electric lamps", D. J. Jones, Metallurgy and Material Technology, vol. 5, No. 10, pp. 503–512, 1973.

"Tooling for Cold Isostatic Pressing", Isostatic Pressing Technology, Applied Science Publishers, New York, edited by P. J. James, 1983, Chapter 4, pp. 90–123 & 160–161.

*Primary Examiner*—Stephen J. Lechert, Jr.

*Attorney, Agent, or Firm*—James E. McGinness; James C. Davis, Jr.; James Magee, Jr.

[57] ABSTRACT

A method of forming tungsten ingots having improved uniformity of density and improved uniformity in distribution of dopant within the ingot is disclosed. Doped tungsten powder is disposed in a cylindrical mold having sealing means at both ends. The powder completely fills a void space within the mold between the sealing means so that there is substantially no settling of the powder. A pressure of about 560 kg/cm$^2$ is applied uniformly to the outer surface of the mold to form a cylindrical compact. The compact is removed from the mold and resistance sintered to a density of at least about 85 percent of theoretical density to form the ingot.

9 Claims, 1 Drawing Sheet

METHOD OF FORMING IMPROVED TUNGSTEN INGOTS

BACKGROUND OF THE INVENTION

This invention relates to a method for preparing tungsten ingots used in the manufacture of tungsten wire filaments for incandescent lamps.

It is known that the tungsten wire used in incandescent lamps is produced from high purity tungsten oxide doped with an alkaline metal, for example, in the form of an alkaline silicate. As used herein, the term "doped" means the intentional addition of an impurity in a very small controlled amount to improve properties such as creep-resistance in articles formed from the doped material. For example, one well known dopant is comprised of potassium disilicate and aluminum chloride and is the dopant referred to in the following background discussion. Doped tungsten oxide powder is reduced to tungsten metal powder containing traces of the dopant within the individual grains of powder. Residues of the dopants remaining on the surface of the reduced powder particles are removed by acid washing, for example, with hydrochloric and hydrofluoric acid.

The doped metal powder is ram pressed to form an elongated compact with a square-like cross-section having four or more sides. In ram pressing, a uniaxial pressure is applied to the powder, and a highly porous and fragile compact is formed. The compact is heated to about 1200° C. in a presintering operation to impart adequate strength for handling and resistance sintering of the compact. A resistance heating current of about 4000 to 6000 amps is transmitted through the compact for sintering. Such resistance sintering heats the compact to about 2600° to 3000° C. and densifies the tungsten powder compact into an ingot.

During sintering, aluminum and silicon diffuse out of the ingot and evaporate away. Much of the potassium, which is insoluble in tungsten, is retained in the form of particles residing in pores inside the ingot. However, sintering provides a driving force for removal of some potassium from the ingot, and a gradient in potassium concentration between the center and outer surface of the ingot is produced during sintering.

The ingot is elongated by swaging, and drawn into a fine wire in a series of annealing and wire drawing operations. During the swaging and drawing processes, the doping material is distributed in long rows of fine pores or bubbles aligned parallel to the wire axis. The bubbles are maintained during the wire reduction processes and in subsequent high temperature operation because of the insolubility of potassium in tungsten and the vapor pressure of the doping substance. After each wire drawing step, highly deformed grains in the tungsten wire are recrystallized by the intermediate anneals. The rows of bubbles prevent movement of grain boundaries perpendicular to the wire axis during and after recrystallization of the wire.

Tungsten filaments are operated in lamps at temperatures of about 2000° to 3000° C. The filament material must be creep-resistant at such elevated temperatures because of high stresses exerted upon the filament by mechanical or thermal means. Creep distorts coiled filaments, increasing the radiation heat loss and decreasing the luminous efficiency of coiled filaments. Creep in tungsten filaments can also cause individual turns between coiled filaments to contact one another and short out, thereby shortening the life of the filament. In addition, excessive creep can result in premature breakage of the filament.

The rows of potassium bubbles pinning the grain boundaries provides a creep-resistant interlocking grain structure for the tungsten wire resulting in long-life filaments. The absence of the bubbles results in creep from grain boundary sliding, and rapid failure in operation of the filament. It is, therefore, necessary that the filament contain potassium or other material which will produce the bubbles described above, and a uniform distribution of the rows of bubbles for providing uniform creep-resistance throughout the entire length of filamentary wire.

It should be understood that one tungsten ingot can be reduced to about 80 kilometers of filamentary wire, and as a result, small non-uniformities of dopant distribution in the tungsten ingot can lead to insufficient bubbles and excessive creep in localized portions of the wire. The tungsten ingot forming process described above tends to produce non-uniformities in dopant distribution resulting from non-uniformities in initial additions or non-uniform removal of dopant during sintering. This leads to inhomogenities in the wire properties giving rise to localized sagging or creep in the filaments.

The numerous swaging and wire drawing operations reducing the radius of the ingot act to homogenize the radial distribution of dopant in the drawn wire. However, non-uniformities in the length dimension of the ingot are exacerbated by the swaging and wire drawing operations. We have discovered that unidirectional ram pressing produces compacts with density variations of about 10 percent along the length of the compact. There is also variation in the mean compact density from pressing to pressing. Resistance heating and, therefore, temperature varies with changes in density, and as a result, variations in the compact density cause non-uniform heating in the compact during the sintering operation. Such non-uniform heating during sintering results in a non-uniform temperature distribution within the ingot, and a non-uniform distribution of dopant along the length dimension of the ingot.

An object of this invention is a method for forming tungsten ingots having a greater uniformity of density within the ingot, and a greater uniformity of density between separate ingots.

Another object of this invention is a method that reduces the steps performed in forming a tungsten ingot.

BRIEF DESCRIPTION OF THE INVENTION

The present invention provides an improved method for preparing tungsten ingots having a greater uniformity of density, and greater uniformity in the distribution of potassium particles therein. The method comprises disposing a doped tungsten powder in an elongate cylindrical elastic mold. The term "doped tungsten powder" means a tungsten powder comprised of at least one element that is insoluble in tungsten in an amount sufficient to improve the creep-resistance of wire formed from the powder. Such insoluble elements have an atomic radius that is at least about 15 percent greater than the atomic radius of tungsten, for example, lithium, sodium, cesium, rubidium, or preferably potassium. The powder completely fills a cylindrical void space within the mold between sealing means at both ends of the mold. The powder is disposed in the mold to have a fill density that minimizes settling of the powder. As used herein, the term "fill density" means the density of powder in the mold prior to compaction.

A pressure of at least about 560 kilograms per square centimeter, $kg/cm^2$, preferably at least about 1760 $kg/cm^2$, is applied uniformly to the outer surface of the mold. This provides a uniform radial pressure on the powder, pressing the powder into a cylindrical compact. The pressure on the mold is reduced at a controlled rate, decompressing the mold at a rate that minimizes cracking or breakage of the compact. Pressure is reduced at a rate up to about 70 $kg/cm^2$/second, preferably up to about 11 $kg/cm^2$/second. A resistance heating current is transmitted through the compact to heat the compact to about 2100° to 3000° C. to form an ingot having a density of at least about 85 percent of theoretical density.

The radial compaction of the doped tungsten powder forms a cylindrical compact having sufficient strength for sintering without a 1200° C. presinter, and improved uniformity of density within the compact and between separate compacts. As a result, temperatures are more uniform within the compact during resistance sintering and potassium is more uniformly distributed in the sintered ingot. It should also be understood that a more uniform temperature distribution is found in resistance sintering of the round cross-section of the cylindrical compact than in resistance sintering of the square-like cross-section of prior known tungsten compacts. The improved uniformity of density in the formed ingots also results in improved workability of the ingot for subsequent fabrication by rolling, swaging, and wire drawing.

DETAILED DESCRIPTION OF THE INVENTION

Figure 1:
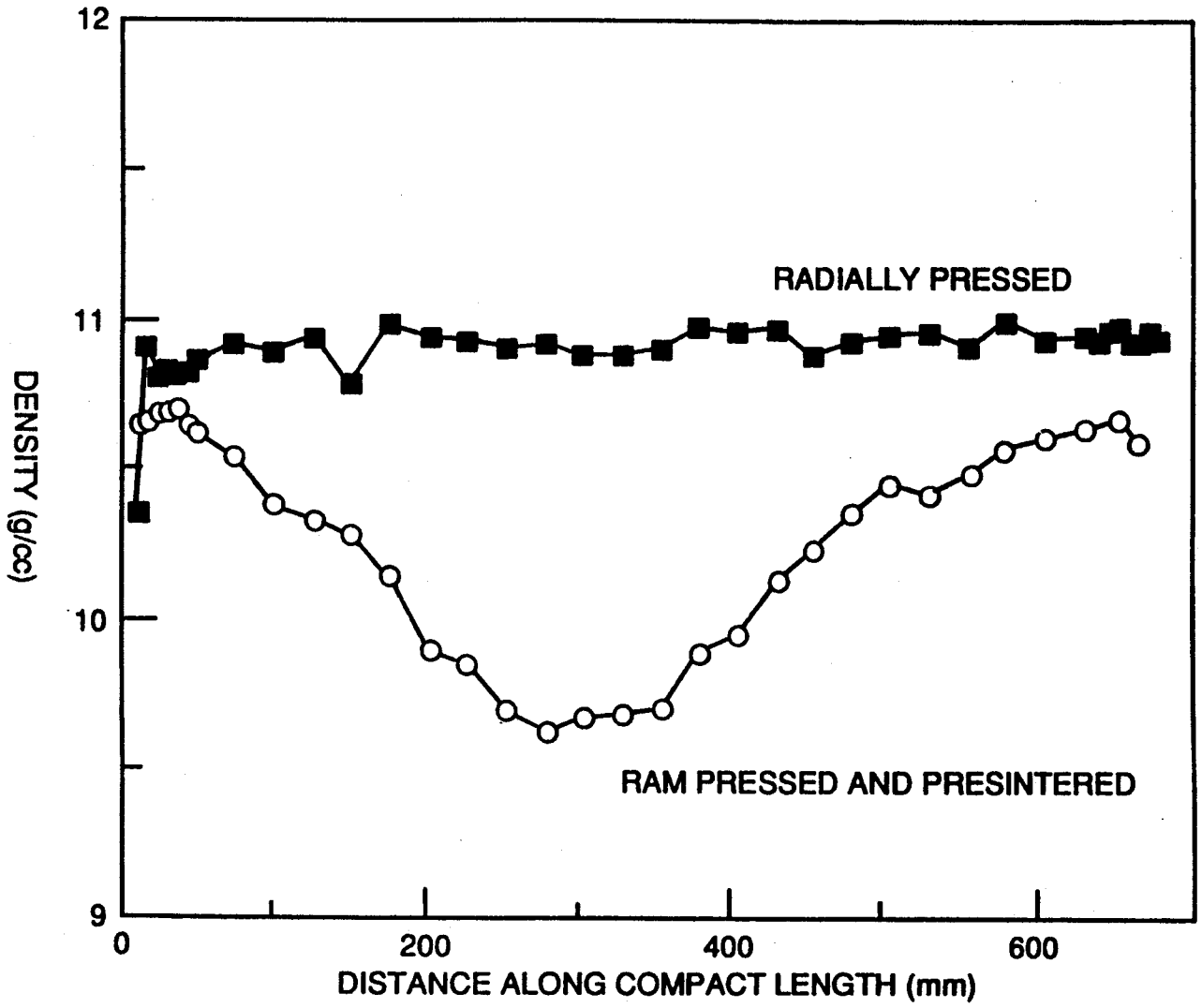
FIG. 1 is a graph showing the change in density along the length of a ram pressed and presintered square-like compact as compared to the change in density along the length of a radially pressed cylindrical compact.

The present invention is directed to a method for making a tungsten ingot having improved uniformity of density, and improved uniformity in the distribution of potassium particles within the ingot, while at the same time reducing the number of steps required in forming the ingots. The doped tungsten metal powder used to form the tungsten ingot is typically a fine powder having an average particle size in the range of about 0.5 to 10 microns, with an average particle size of about 3 to 4 microns being preferred.

The shape of the tungsten particles is important for forming a compact having good strength. During compaction of the tungsten powder, the bonding between the particles will depend largely on the contact surfaces. Bonding is limited to areas of contact between particles where friction exists. Angular or irregular shapes produce greater interlocking between the particles, and are preferred over spherical shaped particles.

The doped tungsten metal powder is formed from a tungsten oxide powder, the oxide being known as tungsten blue oxide and having the approximate composition $WO_3$. The purpose of the dopant is to cause formation of previously described bubbles in the tungsten wire which will inhibit the movement of the grain boundaries in the recrystallized filaments, to provide an interlocked grain structure which results in a long-life filament. Any material which will serve this purpose can be used as a dopant in the method of this invention. In general, in order to perform this function the dopant must be insoluble in tungsten and have an atomic radius that is at least about 15 percent and preferably about 15 to about 30 percent greater than the atomic radius of tungsten. Tungsten has an atomic radius of about 2 angstroms. Thus, suitable dopants for use in this invention generally have atomic radius of at least about 2.3, and preferably about 2.3 to about 2.6 angstroms.

Some of the known dopants at least include an alkaline metal such as lithium, sodium, potassium, rubidium, or cesium. The alkaline metal dopant is generally added as a compound of the alkaline metal, aluminum, and silicon. However, the dopant may be an alkaline silicate, or an alkaline aluminum silicate. A preferred dopant is comprised of potassium silicate and aluminum chloride, with potassium remaining as the dopant in the sintered tungsten ingot.

About 50 to about 90, and preferably about 70 to about 75 parts per million of elemental metallic dopant is suitable in the final tungsten ingot. Therefore, sufficient potassium silicate, and aluminum chloride are added to the tungsten oxide powder to yield the desired amount of elemental dopant in the final tungsten ingot. As described above, a significant amount of dopant is lost during acid washing and sintering of the powder. However, the amount of dopant that is to be added to the tungsten blue oxide powder can be determined empirically. Dopant is added at various levels to the powder and formed into a sintered ingot by the method of this invention. The dopant level in the sintered ingot is then measured to determine what levels of initial dopant yield about 50 to 90 parts per million elemental metallic dopant.

For example, tungsten oxide powder can be doped by adding about 0.9 liters of an aqueous potassium silicate doping solution to about 4 kilograms of tungsten blue oxide with good mixing for about one and one-half hours. About 0.15 liters of an aqueous aluminum chloride solution is added by thorough mixing, and a gel forms that coats the particles. The aqueous potassium silicate and aluminum chloride doping solutions are at a concentration that deposits about 1000 parts per million potassium, about 2400 parts per million silicon, and 650 parts per million aluminum on the oxide powder particles. Potassium disilicate enters pores and fissures in the oxide powder during the mixing.

The doped tungsten oxide powder is reduced to tungsten metal powder by heating to about 700° to 900° C. in a reducing atmosphere such as hydrogen. The reduced tungsten metal powder contains traces of potassium, aluminum, and silicon as salts within the individual powder grains. Residues of the dopant materials remaining on the surface of the reduced powder particles are removed by acid washing, with hydrochloric and hydrofluoric acids.

The doped tungsten metal powder is disposed in a cylindrical elastic mold and radially compacted. An apparatus for performing such radial compaction operations is well known in the art as a dry bag cold isostatic press. See "Isostatic Pressing Technology", edited by P. J. James, Applied Science Publishers, New York, Chapter 4, "Tooling for Cold Isostatic Pressing", pp. 91–119, incorporated by reference herein. Dry bag cold isostatic pressing is sometimes herein referred to as dry bag pressing.

In dry bag pressing, an elastic bag or mold is fixed within a pressure vessel. The elastic mold has at least one open end which is sealed with the pressure vessel so that the fluid pressure medium within the vessel cannot enter the mold interior. The elastic mold is made from a material which does not chemically react with either the powder or the pressure medium, and readily releases from the tungsten powder compact. A material having a high resistance to wear from the tungsten powder is also desirable. Mold materials that can be used include natural rubber, neoprene, polyvinyl chloride, butyl, nitrile, silicone, and preferably urethane.

In the method of this invention a cylindrical elastic mold is used that is open at both ends, and has a cylindrical void space therein. Sealing means for the open mold ends are provided by wear resistant metal punches. The punches are located and restrained by the yoke of the press, and guided into the bag by wear resistant bushes mounted in the pressure vessel. The top punch is removed and powder is charged into the void space in the mold completely filling the void space between the sealing means. The powder is charged into the mold by means well known in the art for providing a fill density that does not allow settling of the powder prior to compaction. A powder fill density of at least about 5 grams per cubic centimeter, and preferably about 6 grams per cubic centimeter is adequate. One method for providing such a fill density comprises pouring a small amount of powder in the mold followed by tamping of the powder, and repeating this procedure until the void space is filled.

The top punch is engaged in the mold and a fluid pressure medium is applied to the outside of the mold. The mold is supported by a metal cage or lantern ring which keeps the mold radially located, and distributes the fluid pressure medium evenly around the bag. A pressure of at least about 560 kg/cm$^2$, preferably at least about 1760 kg/cm$^2$, is used to compact the doped tungsten powder. Preferably, the radial pressure is applied for at least about 30 seconds to densify the doped tungsten powder to at least about 50 percent, preferably at least about 60 percent of theoretical density. Such compaction provides significant strength to the compact so that it can be easily handled and has sufficient structural strength to withstand the resistance sintering operation, without the need of a presinter operation.

The radial pressure applied to the mold by the fluid pressure medium is slowly removed in a controlled fashion to provide a controlled decompression of the compact. An uneven decompression of the compact may result in cracking or breakage of the compact. Pressure is reduced at a rate up to about 70 kg/cm$^2$/second, preferably up to about 11 kg/cm$^2$/second to prevent such cracking or breakage of the compact.

A tendency toward flaring of the ends of the formed compact can be minimized by careful adjustment of the inner surface profile in the mold. The punches sealing the ends of the cylindrical mold are provided to have a smaller diameter than the internal void space diameter of the cylindrical mold. The ends of the mold which seal around the punches are formed to correspond to the smaller diameter of the punches. The internal void space then has a small tapered section adjacent the punches tapering from the smaller diameter of the punches to the larger diameter of the void space. Flared ends observed on some formed compacts were minor and are considered negligible, because the flaring is within a portion of the ends that is normally trimmed off the ingot after sintering.

The internal diameter of the void space in the mold is dependent upon the compaction ratio of the powder to be pressed. The compaction ratio and internal diameter are determined by means well known in the art to form a compact of the desired diameter. Such methods are described, for example, in "Tooling for Cold Isostatic Pressing" referenced above. For example, a tungsten compact of about 22 millimeters in diameter can be formed from a mold having an internal void space of 30.5 millimeters in diameter.

The pressed compact is removed from the mold and sintered by resistance heating. A resistance heating current of about 4,000 to 6,500 amps is transmitted through the compact according to cycles well known in the art. For example see "Application of Tungsten Wire as the Light Source in Incandescent Electric Lamps," D. J. Jones, Metallurgy and Material Technology, Volume 5 No. 10, pp. 503–512, 1973. Such resistance heating is sufficient to heat the ingot to about 2,100° to 3,000° C. where it is sintered to about 85 percent of theoretical density.

EXAMPLE I

In this example a tungsten compact was made by the method of this invention and another tungsten compact was made by the previously described prior art process of ram pressing and presintering. Potassium doped tungsten powder having an average particle size of about 3.5 microns was used to form both compacts. Density measurements were made on the formed compacts to compare the uniformity of density along the length of each compact.

A cylindrical urethane mold having an inside diameter of about 30.5 millimeters and a length of about 811 millimeters was sealed at one end with a punch about 30.5 millimeters in diameter and 63.5 millimeters in length. Doped tungsten metal powder was poured from a vibratory feeder at a rate of about 150 grams per second into the mold. The open end of the mold was sealed with another punch of similar size, and the powder completely filled the void space, about 684 millimeters in length, between the punches at both ends of the mold. The sealed mold was placed in a pressure vessel, and the pressure vessel was located within a yolk that fixedly supported the punches.

Pressure was uniformly applied to the outer surface of the mold by a liquid pressure medium introduced into the pressure vessel at a rate of about 11 to 70 kg/cm$^2$/second. When a pressure of about 1760 kg/cm$^2$ was reached, pressurization was stopped and the pressure was maintained for about 30 seconds. Pressure was then reduced at a rate of about 11 kg/cm$^2$/second. The punches were removed from the ends of the mold and the cylindrical compact was removed. The compact had a density of about 11 grams per cubic centimeter.

A tungsten compact having a square-like cross-section was made by the prior art process described above. A tool steel mold 650 millimeters in length, and having a square-like cross-section of about 22.3 millimeters across the other dimensions was manually filled with the doped tungsten powder. A uniaxial pressure of about 844 kg/cm$^2$ was applied to the powder with a ram press that formed one side of the mold. After pressing, the compact was carefully removed from the mold and presintered at 1200° C. in a hydrogen atmosphere.

Density measurements were made at various points along the length of each compact by a gamma radiation attenuation technique well known in the art. The density measurements from each compact are shown in FIG. 1. FIG. 1 is a graph of density measurements in grams per cubic centimeter, plotted on the ordinate, at various points along the length of the ram pressed and radially pressed compacts, as plotted on the abscissa. As shown in FIG. 1, the density varied by as much as 10 percent along the length of the ram pressed and presintered compact, while the cylindrical compact of this invention had a much more uniform density varying less than about 2 percent.

The cylindrical compact was resistance sintered to a density of about 85 percent of theoretical density. No presintering operation was required and the cylindrical compact was found to be strong enough for handling, and able to withstand the resistance sintering without distorting, or breaking. The ingot was substantially straight along its axis, a desirable shape for swaging and wire drawing.

We claim:

1. A method for forming a tungsten ingot suitable for reduction to filamentary wire used in incandescent lamps, comprising;

disposing a doped tungsten powder in an elongate cylindrical elastic mold having an internal void space between sealing means at both ends of the mold, the powder completely filling the void space between the sealing means to have a fill density that minimizes settling of the powder;

consolidating the powder into a cylindrical compact by applying a pressure uniformly to the outer surface of the mold of at least about 560 kg/cm$^2$;

decompressing the mold with a controlled reduction in pressure up to about 70 kg/cm$^2$/second; and sintering the compact to a density of at least about 85 percent of theoretical density to form the ingot.

2. The method of claim 1 wherein the doped tungsten powder is comprised of about 50 to 90 parts per million of potassium and the balance substantially tungsten.

3. The method of claim 1 where the void space is a cylindrical space.

4. The method of claim 1 where the powder filling the void space has a density of at least about 5 grams per cubic centimeter.

5. The method of claim 1 where the pressure is at least about 1760 kg/cm$^2$.

6. The method of claim 1 where the pressure is applied for at least about 30 seconds.

7. The method of claim 1 where the reduction in pressure is up to about 11 kg/cm$^2$/second.

8. A method for forming a tungsten ingot suitable for reduction to filamentary wire used in incandescent lamps, comprising;

disposing a potassium doped tungsten powder in an elongate cylindrical elastic mold having a cylindrical internal void space between sealing means at both ends of the mold, the powder completely filling the void space between the sealing means to have a fill density of at least about 6 grams per cubic centimeter;

consolidating the powder into a cylindrical compact by applying a pressure uniformly to the outer surface of the mold to form a compact having a density of at least about 50 percent of theoretical density;

decompressing the mold with a controlled reduction in pressure up to about 11 kg/cm$^2$/second; and sintering the compact to a density of at least about 85 percent of theoretical density to form the ingot.

9. The method of claim 8 wherein the compact has a density of at least about 60 percent of theoretical density.

* * * * *